US009909792B2

(12) United States Patent
Oya

(10) Patent No.: US 9,909,792 B2
(45) Date of Patent: Mar. 6, 2018

(54) REFRIGERATION CYCLE APPARATUS

(71) Applicant: Mitsubishi Electric Corporation, Tokyo (JP)

(72) Inventor: Ryo Oya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 263 days.

(21) Appl. No.: 14/526,583

(22) Filed: Oct. 29, 2014

(65) Prior Publication Data

US 2015/0219371 A1 Aug. 6, 2015

(30) Foreign Application Priority Data

Jan. 31, 2014 (JP) ..... 2014-017486

(51) Int. Cl.
*F25B 27/00* (2006.01)
*F25B 30/06* (2006.01)
*F25B 49/02* (2006.01)

(52) U.S. Cl.
CPC ..... *F25B 27/00* (2013.01); *F25B 30/06* (2013.01); *F25B 49/02* (2013.01);
(Continued)

(58) Field of Classification Search
CPC ..... F25B 2313/002; F25B 2313/009; F25B 2313/0211; F25B 30/06; F25B 2339/047;
(Continued)

(56) References Cited

U.S. PATENT DOCUMENTS 5,983,660 A * 11/1999 Kiessel ..... F25B 13/00 62/260
2004/0000399 A1* 1/2004 Gavula ..... F25B 13/00 165/299

(Continued)

FOREIGN PATENT DOCUMENTS

CN 203223456 U 10/2013
CN 203323456 U 12/2013

(Continued)

OTHER PUBLICATIONS

Tomczyk, John, "The Professor: Condensing Temperatures and Condensing Splits", Jul. 2, 2012.*

(Continued)

*Primary Examiner* — David Teitelbaum
*Assistant Examiner* — Schyler S Sanks
(74) *Attorney, Agent, or Firm* — Posz Law Group, PLC

(57) ABSTRACT

A refrigeration cycle apparatus includes a compressor, a water-refrigerant heat exchanger, pressure reducing devices which reduce the pressure of a refrigerant, an air-side heat exchanger, an outdoor fan which delivers air to the air-side heat exchanger, a geothermal-side heat exchanger, a switching device which switches a flow passage so that the air-side heat exchanger or the geothermal-side heat exchanger functions as an evaporator, and a controller. The controller controls the switching device so that, when the geothermal-side heat exchanger functions as an evaporator, the air-side heat exchanger and the water-refrigerant heat exchanger are connected in parallel, and stops the outdoor fan.

9 Claims, 4 Drawing Sheets

(52) U.S. Cl.
CPC ... *F25B 2313/002* (2013.01); *F25B 2313/009* (2013.01); *F25B 2313/021* (2013.01); *F25B 2313/0292* (2013.01); *F25B 2313/0294* (2013.01); *F25B 2313/0314* (2013.01); *F25B 2339/047* (2013.01); *F25B 2700/1931* (2013.01); *F25B 2700/2106* (2013.01); *F25B 2700/2116* (2013.01)

(58) Field of Classification Search
CPC ..... F25B 27/00; F25B 2700/1931; F25B 2700/2106; F25B 2700/2116; F25B 2700/21163; F25B 2313/004; F25B 2313/003; F25B 2313/02532; F24D 19/1054
See application file for complete search history.

(56) References Cited

U.S. PATENT DOCUMENTS

2013/0306301 A1* 11/2013 Tamaki ..... F25B 30/00 165/287
2015/0121913 A1* 5/2015 Kato ..... F25B 47/025 62/81
2015/0219371 A1 8/2015 Oya

FOREIGN PATENT DOCUMENTS

| | | | | |
|---|---|---|---|---|
| CN | 204313531 | U | 5/2015 | |
| EP | 2669605 | A1 | 12/2013 | |
| JP | S55-011068 | A | 2/1980 | |
| JP | 2001-099528 | A | 4/2001 | |
| JP | 2006-125769 | A | 5/2006 | |
| JP | 2010-216783 | A | 9/2010 | |
| JP | WO 2012101804 | A1 * | 8/2012 | ..... F25B 30/00 |
| JP | WO 2013172166 | A1 * | 11/2013 | ..... F25B 47/025 |

OTHER PUBLICATIONS

Extended European Search Report dated Jun. 12, 2015 in the corresponding EP application No. 14191435.8.
Office Action dated Sep. 2, 2016 issued in corresponding CN patent application No. 201410696699.X (and English translation).
Office Action dated Jan. 24, 2017 issued in corresponding JP patent application No. 2014-017486 (and English translation).
Office Action dated Aug. 29, 2017 issued in corresponding JP patent application No. 2014-017486 (and English translation).

* cited by examiner

REFRIGERATION CYCLE APPARATUS

TECHNICAL FIELD

The present invention relates to a refrigeration cycle apparatus.

BACKGROUND ART

Known heat pump systems execute a hot water supply operation using an air-side heat exchanger as an evaporator when the outside air temperature is higher than the geothermal-side temperature, and execute a hot water supply operation using a geothermal-side heat exchanger as an evaporator when the outside air temperature is lower than the geothermal-side temperature (see, for example, Patent Literature 1).

There have also been air-conditioning systems which cause a refrigerant to flow to an air-side heat exchanger when the temperature of the refrigerant is higher than a predetermined temperature and which cause a refrigerant to flow to a heat exchanger utilizing earth heat (geothermal-side heat exchanger) when the temperature of the refrigerant is lower than or equal to the predetermined temperature (see, for example, Patent Literature 2).

CITATION LIST

Patent Literature

[Patent Literature 1] Japanese Unexamined Patent Application Publication No. 2006-125769 ([0033] to [0040], FIG. 1)

[Patent Literature 2] Japanese Unexamined Patent Application Publication No. 2010-216783 ([0034] to [0051], FIG. 1 and FIG. 3)

SUMMARY OF INVENTION

Technical Problem

In the heat pump system described in Patent Literature 1 and the air-conditioning system described in Patent Literature 2, an air-side heat exchanger and a geothermal-side heat exchanger are provided in parallel, and a refrigerant which has flowed out of the air-side heat exchanger and a refrigerant which has flowed out of the geothermal-side heat exchanger merge together at a downstream portion of the air-side heat exchanger and the geothermal-side heat exchanger. With this merging, even when the outside air temperature is low and the geothermal-side heat exchanger is therefore used, the suction pressure of a compressor is lower than the saturation pressure of the outside air. This poses a problem that an effect of the switching cannot be fully utilized.

Further, with the heat pump system described in Patent Literature 1 and the air-conditioning system described in Patent Literature 2, stagnation of a refrigerant occurs to an air-side heat exchanger which is not being used. Therefore, there is a problem in that a shortage of refrigerant may occur when the compressor starts to operate.

The present invention has been made in view of the above-mentioned problems, and it is an object of the present invention to reduce, compared to related art, the influence of an air-side heat exchanger which is not used as an evaporator, and to secure, compared to related art, the suction pressure obtained from a geothermal-side heat exchanger which is used as an evaporator, when the outside air temperature is low.

Solution to Problem

A refrigeration cycle apparatus according to the present invention includes a compressor which compresses a sucked refrigerant and discharges the compressed refrigerant; a condenser which condenses the refrigerant by performing heat exchange with a heat exchange target; a pressure reducing device which reduces a pressure of the refrigerant; an air-side heat exchanger which evaporates the refrigerant by performing heat exchange with outside air; an outdoor fan which delivers air to the air-side heat exchanger; a geothermal-side heat exchanger which evaporates the refrigerant by performing heat exchange with ground; a switching device which performs switching of a flow passage so that the air-side heat exchanger or the geothermal-side heat exchanger functions as an evaporator; and controller for controlling the switching device so that the air-side heat exchanger and the condenser are connected in parallel, and for stopping the outdoor fan, when the geothermal-side heat exchanger functions as an evaporator.

Advantageous Effects of Invention

In the refrigeration cycle apparatus according to the present invention, when the geothermal-side heat exchanger functions as an evaporator, the controller controls the switching device so that the air-side heat exchanger and the condenser are connected in parallel, and stops the outdoor fan. Accordingly, when the outside air temperature is low, the influence of the air-side heat exchanger, which is not used as an evaporator, can be reduced compared to related art, and the suction pressure obtained from the geothermal-side heat exchanger, which is used as an evaporator, can be secured compared to related art.

DESCRIPTION OF EMBODIMENTS

Embodiment 1.

Figure 1:
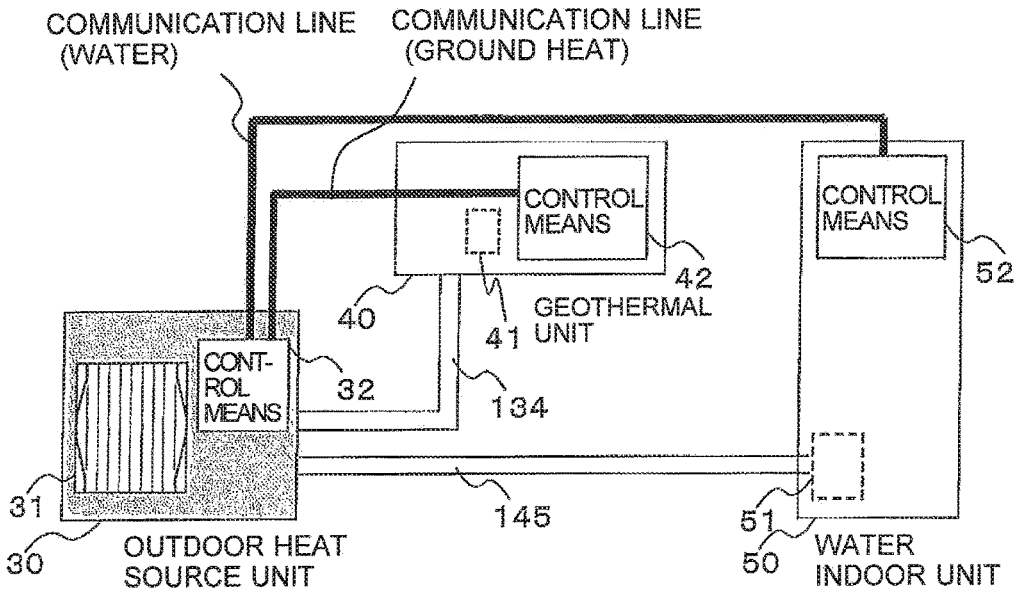
FIG. 1 is a schematic diagram of a configuration of a refrigeration cycle apparatus 100 according to Embodiment 1 of the present invention.
Figure 2:
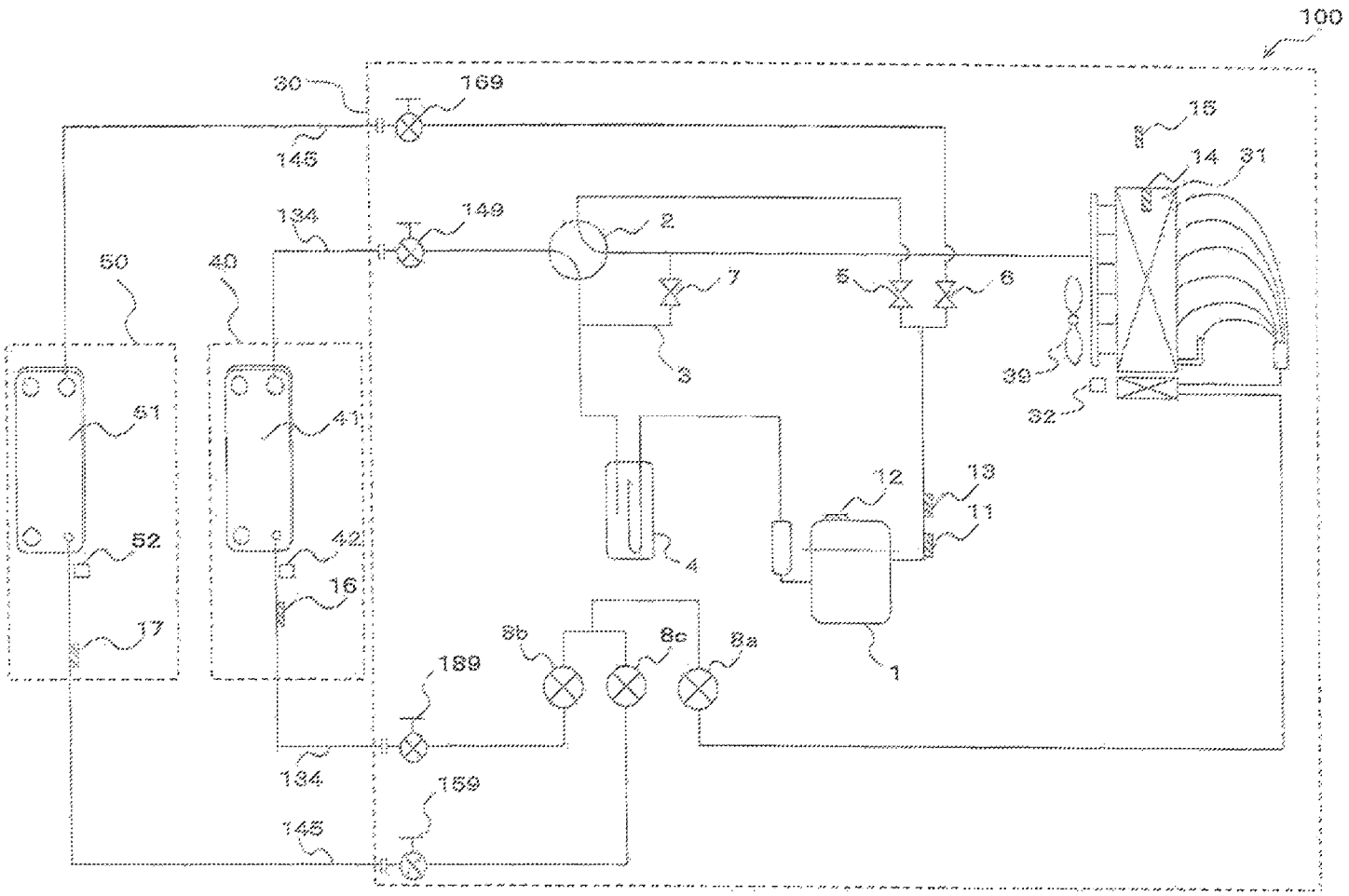
FIG. 2 is a refrigerant circuit diagram of the refrigeration cycle apparatus 100 according to Embodiment 1 of the present invention.

FIG. 1 is a schematic diagram of a configuration of a refrigeration cycle apparatus 100 according to Embodiment 1 of the present invention. FIG. 2 is a refrigerant circuit diagram of the refrigeration cycle apparatus 100 according to Embodiment 1 of the present invention.

As illustrated in FIG. 1, the refrigeration cycle apparatus 100 includes an outdoor heat source unit 30, a geothermal unit 40, and a water indoor unit 50. The outdoor heat source unit 30 and the geothermal unit 40 are connected by a refrigerant pipe 134. The outdoor heat source unit 30 and the water indoor unit 50 are connected by a refrigerant pipe 145.

As illustrated in FIG. 2, the outdoor heat source unit 30 includes a compressor 1, a four-way valve 2, an accumulator 4, a first solenoid valve 5, a second solenoid valve 6, a first pressure reducing device (LEV) 8*a*, a second pressure reducing device (LEV) 8*b*, a third pressure reducing device (LEV) 8*c*, an outside air temperature sensor 15, an air-side heat exchanger 31, controller 32, an outdoor fan 39, and stop valves 149, 159, 169, and 189.

The compressor 1 is, for example, a compressor whose capacity can be controlled by inverter driving control. The compressor 1 compresses a sucked refrigerant and discharges the compressed refrigerant. The refrigerant used in the refrigeration cycle apparatus 100 is, for example, an HFC-type refrigerant, such as R410A, R407C, or R32, a natural refrigerant, such as a hydrocarbon or helium refrigerant, or the like.

The compressor 1 is provided with a pressure sensor 11, a compressor shell temperature sensor 12, and a discharge pipe temperature sensor 13. The pressure sensor 11 detects the discharge pressure of the compressor 1. The compressor shell temperature sensor 12 is temperature detection means for detecting the surface temperature of the compressor 1. The discharge pipe temperature sensor 13 is temperature detection means for detecting the discharge temperature of a refrigerant, and is provided on the discharge side of the compressor 1.

The four-way valve 2 is a valve for switching between a flow passage connecting the accumulator 4 with the geothermal-side heat exchanger 41 and connecting the first solenoid valve 5 with the air-side heat exchanger 31, and a flow passage connecting the accumulator 4 with the air-side heat exchanger 31 and connecting the first solenoid valve 5 with the geothermal-side heat exchanger 41. By switching the four-way valve 2, the direction in which a refrigerant flows changes. The accumulator 4 accumulates an excess refrigerant in a liquid state, and causes a gas refrigerant to flow to the suction side of the compressor 1.

The first solenoid valve 5 is a valve for allowing or blocking the passage of a refrigerant and is provided at a portion on the discharge side of the compressor 1 and on the upstream side of the four-way valve 2. The second solenoid valve 6 is a valve for allowing or blocking the passage of a refrigerant and is provided at a portion on the discharge side of the compressor 1 and on the upstream side of the stop valve 169. Since the first solenoid valve 5 and the second solenoid valve 6 are provided in parallel on the downstream side of the compressor 1, the refrigerant which has been discharged from the compressor 1 passes through the first solenoid valve 5 or the second solenoid valve 6.

The first pressure reducing device 8*a*, the second pressure reducing device 8*b*, and the third pressure reducing device 8*c* are devices for adjusting (reducing) the pressure of a refrigerant. By closing the devices, the direction in which the refrigerant flows changes. The outside air temperature sensor 15 is temperature detection means for detecting the temperature of the outside air flowing into the air-side heat exchanger 31, and is provided on the suction side of the outside air.

The air-side heat exchanger 31 is, for example, a fin-and-tube-type heat exchanger, and evaporates a refrigerant by performing heat exchange with the outside air. The air-side heat exchanger 31 is provided with an air-side heat exchanger temperature sensor 14 and the outdoor fan 39. The air-side heat exchanger temperature sensor 14 is temperature detection means for detecting the temperature of a refrigerant at the air-side heat exchanger 31. The outdoor fan 39 is air-sending means provided for performing heat exchange between the outside air flowing on the surface of the air-side heat exchanger 31 and a refrigerant flowing into the air-side heat exchanger 31.

The controller 32 controls the compressor 1, the four-way valve 2, and the like, based on at least one of the detection values of various sensors. The various sensors include the pressure sensor 11, the compressor shell temperature sensor 12, the discharge pipe temperature sensor 13, the air-side heat exchanger temperature sensor 14, the outside air temperature sensor 15, a geothermal temperature sensor 16, a refrigerant temperature sensor 17, an inflow water temperature sensor, and an outflow water temperature sensor. The details of the geothermal temperature sensor 16, the inflow water temperature sensor, and the outflow water temperature sensor will be described later.

The geothermal unit 40 includes the geothermal-side heat exchanger 41, controller 42, and the geothermal temperature sensor 16. The geothermal-side heat exchanger 41 is, for example, a plate-type water heat exchanger, and evaporates a refrigerant by performing heat exchange with the ground. To the geothermal-side heat exchanger 41, a water pump (not illustrated in figures) and an underground heat collecting pipe (not illustrated in figures) are connected. The geothermal-side heat exchanger 41 forms part of a water circuit through which an antifreeze solution, which is a heat exchange medium, circulates. The geothermal-side heat exchanger 41 performs heat exchange between a refrigerant flowing through the geothermal-side heat exchanger 41 and the antifreeze solution circulating through the water circuit, and evaporates the refrigerant by ground heat.

In the case where, for example, there is hot water supply request information of the geothermal unit 40, the controller 42 sends to the controller 32 of the outdoor heat source unit 30 a signal requesting for driving of the compressor 1. The controller 42 and the controller 32 are connected by a communication line. The geothermal temperature sensor 16 is temperature detection means for detecting the temperature of a liquid refrigerant, and is provided on the liquid-side pipe for the geothermal-side heat exchanger 41.

The water indoor unit 50 includes a water-refrigerant heat exchanger 51, controller 52, a refrigerant temperature sensor 17, a water pump (not illustrated in figures), a hot water storage tank (not illustrated in figures), an inflow water temperature sensor (not illustrated in figures), and an outflow water temperature sensor (not illustrated in figures). The water-refrigerant heat exchanger 51 is, for example, a plate-type water heat exchanger. To the water-refrigerant heat exchanger 51, the water pump and the hot water storage tank are connected in order by a pipe. The water-refrigerant heat exchanger 51 forms part of the water circuit through which water, which is a heat exchange medium, circulates. The water-refrigerant heat exchanger 51 performs heat exchange between a refrigerant flowing through the water-refrigerant heat exchanger 51 and water circulating through the water circuit, thereby increasing the water temperature.

The controller 52 controls the water pump provided in the water circuit to adjust the amount of water flowing into the water-refrigerant heat exchanger 51. The controller 52 and the controller 32 are connected by a communication line. The refrigerant temperature sensor 17 is temperature detection means for detecting the temperature of a liquid refrigerant on the liquid side, which is the outflow side, of the refrigerant pipe for the water-refrigerant heat exchanger 51.

The inflow water temperature sensor is temperature detection means for detecting the temperature (inlet water temperature) of water flowing in on the water circuit side of the water-refrigerant heat exchanger 51. The outflow water temperature sensor is temperature detection means for detecting the temperature (outlet water temperature) of water flowing out of the water-refrigerant heat exchanger 51.

The water that exchanges heat with a refrigerant at the water-refrigerant heat exchanger 51 will be described below. The water whose temperature has increased by exchanging heat with a refrigerant at the water-refrigerant heat exchanger 51, circulates inside the hot water storage tank. The water which circulates inside the hot water storage tank, as intermediate water, exchanges heat with the water inside the hot water storage tank, without mixing with the water inside the hot water storage tank, thereby decreasing the temperature of the water. The water whose temperature has decreased by exchanging heat with the water inside the hot water storage tank, flows out of the hot water storage tank, and is again supplied to the water-refrigerant heat exchanger 51. The water exchanges heat with a refrigerant, thereby increasing the temperature of the water.

The stop valves 149, 159, 169, and 189 are provided on corresponding connection pipes. The stop valves 149, 159, 169, and 189 are closed when works of connecting refrigerant pipes, or the like, are performed, in order to prevent a refrigerant in the outdoor heat source unit 30 from flowing out. The positions at which the stop valves 149, 159, 169, and 189 are provided are, for example, as (a) to (d) described below.

(a) The stop valve 149 is provided on the downstream side of the geothermal-side heat exchanger 41.

(b) The stop valve 159 is provided between the third pressure reducing device 8*c* and the water-refrigerant heat exchanger 51.

(c) The stop valve 169 is provided between the second solenoid valve 6 and the water-refrigerant heat exchanger 51.

(d) The stop valve 189 is provided between the second pressure reducing device 8*b* and the geothermal-side heat exchanger 41.

The controller 32 controls the compressor 1 and the like, based on information sent from, for example, the controller 42 and the controller 52. In order for the air-side heat exchanger 31 or the geothermal-side heat exchanger 41 to function as an evaporator, the controller 32 controls at least one of the four-way valve 2, the first solenoid valve 5, the second solenoid valve 6, a third solenoid valve 7, the first pressure reducing device 8*a*, the second pressure reducing device 8*b*, and the third pressure reducing device 8*c*. A target controlled at this time corresponds to a switching device of the present invention. The controller 32, 42, and 52 are, for example, hardware, such as a circuit device which implements the above-mentioned function, or software which is executed on a computing device, such as a microcomputer or a CPU.

Figure 3:
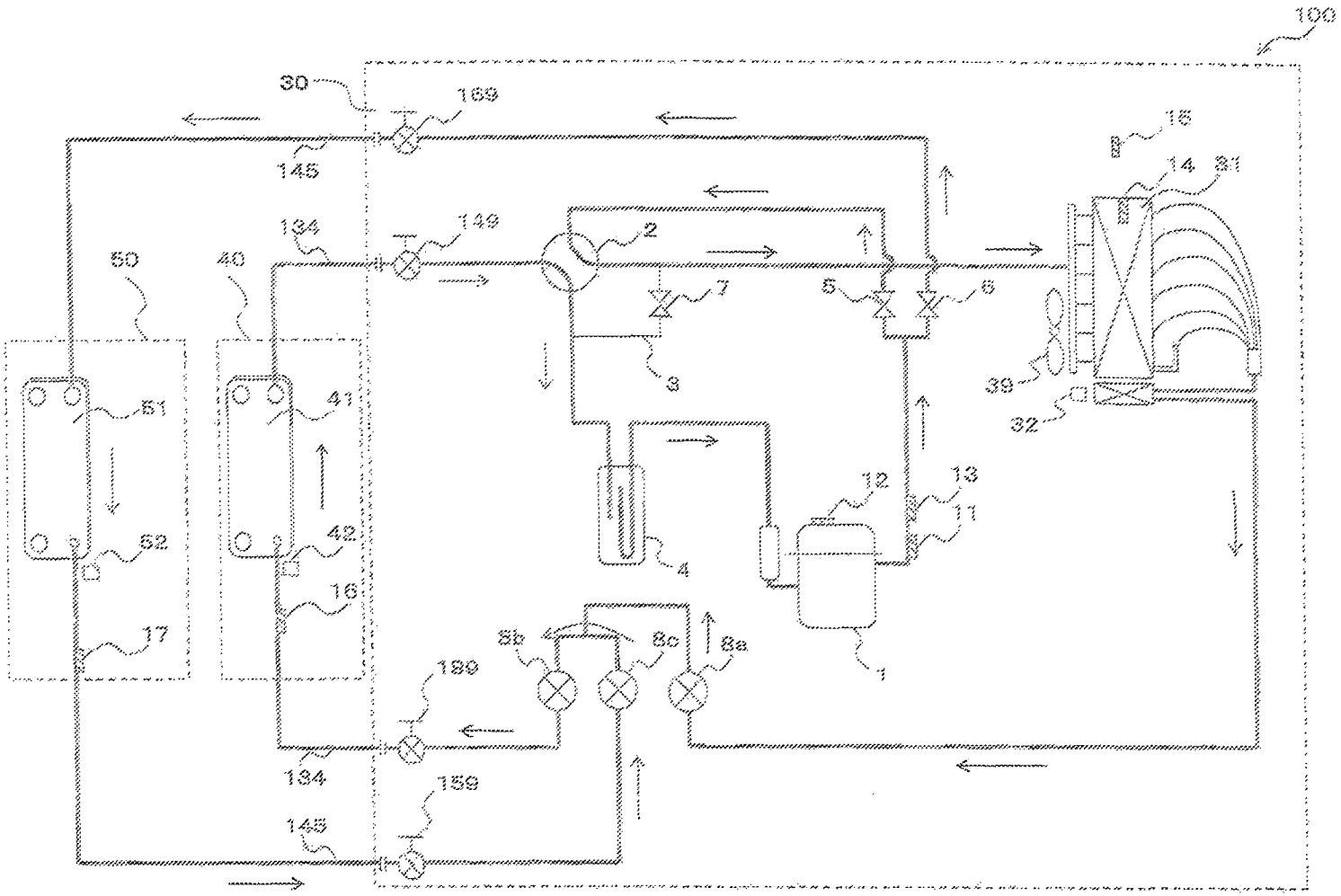
FIG. 3 is a refrigerant circuit diagram of the refrigeration cycle apparatus 100 using a geothermal-side heat exchanger 41 as an evaporator at the time of a geothermal hot water supply operation according to Embodiment 1 of the present invention.

FIG. 3 is a refrigerant circuit diagram of the refrigeration cycle apparatus 100 using the geothermal-side heat exchanger 41 as an evaporator at the time of a geothermal hot water supply operation according to Embodiment 1 of the present invention. A geothermal hot water supply operation of the refrigeration cycle apparatus 100 will be described below with reference to FIG. 3. The arrows in FIG. 3 represent a direction in which a refrigerant flows. The refrigerant circuit at the time of the geothermal hot water supply operation is as (1) to (3) described below.

(1) The compressor 1, the first solenoid valve 5, the four-way valve 2, the air-side heat exchanger 31, the first pressure reducing device 8*a*, the second pressure reducing device 8*b*, the stop valve 189, the geothermal-side heat exchanger 41, the stop valve 149, the four-way valve 2, and the accumulator 4 are connected in order.

(2) The second solenoid valve 6, the stop valve 169, the water-refrigerant heat exchanger 51, the stop valve 159, and the third pressure reducing device 8*c* are connected in order between a portion between the compressor 1 and the first solenoid valve 5 and a portion between the air-side heat exchanger 31 and the third pressure reducing device 8*c*.

(3) A bypass pipe 3 which connects a pipe connecting the first solenoid valve 5 to the air-side heat exchanger 31 via the four-way valve 2, with a pipe connecting the geothermal-side heat exchanger 41, the stop valve 149, the four-way valve 2, and the accumulator 4 together, is provided. The third solenoid valve 7 is provided on the bypass pipe 3.

At the time of the geothermal hot water supply operation, the controller 32 switches the four-way valve 2 so that the geothermal hot water supply operation can be performed. The controller 32 controls the first solenoid valve 5, the second solenoid valve 6, and the third solenoid valve 7 so that the first solenoid valve 5 is in an opened state, the second solenoid valve 6 is in an opened state, and the third solenoid valve 7 is in a closed state. The first pressure reducing device 8*a*, the second pressure reducing device 8*b*, and the third pressure reducing device 8*c* are all set to be fully opened. That is, when performing the geothermal hot water supply operation (when the geothermal-side heat exchanger 41 functions as an evaporator), the controller 32 controls the four-way valve 2 and the like so that the air-side heat exchanger 31 and the water-refrigerant heat exchanger 51 are connected in parallel.

At the time of the geothermal hot water supply operation, part of the refrigerant which has been discharged from the compressor 1 passes, in order, through the second solenoid valve 6, the stop valve 169, and the refrigerant pipe 145, and then flows into the water-refrigerant heat exchanger 51 of the water indoor unit 50. The refrigerant which has flowed into the water-refrigerant heat exchanger 51 heats water supplied by the water pump, turns into a high-pressure liquid refrigerant, and then flows out of the water-refrigerant heat exchanger 51.

The refrigerant which has flowed out of the water-refrigerant heat exchanger 51 flows into the outdoor heat source unit 30 through the refrigerant pipe 145, passes, in order, through the stop valve 159, the third pressure reducing device 8*c*, and the second pressure reducing device 8*b*, and is decompressed into a low-pressure two-phase refrigerant. The low-pressure two-phase refrigerant passes through the stop valve 189 and the refrigerant pipe 134, and then flows into the geothermal-side heat exchanger 41. The refrigerant which has flowed into the geothermal-side heat exchanger 41 exchanges heat with an antifreeze solution passing through the water circuit, and flows out of the geothermal-side heat exchanger 41. The refrigerant which has flowed out of the geothermal-side heat exchanger 41 passes, in order, through the refrigerant pipe 134, the stop valve 149, the four-way valve 2, and the accumulator 4, and then returns to the compressor 1.

At the time of the geothermal hot water supply operation, the refrigerant which has been discharged from the compressor 1 and has not passed through the second solenoid valve 6 passes, in order, through the first solenoid valve 5 and the four-way valve 2, and then flows into the air-side heat exchanger 31. The controller 32 suspends the operation of the outdoor fan 39, and the amount of heat exchange at the air-side heat exchanger 31 can therefore be minimized. The refrigerant which has flowed out of the air-side heat exchanger 31 passes through the first pressure reducing device 8*a*, and merges with the refrigerant which has flowed out of the water-refrigerant heat exchanger 51.

Figure 4:
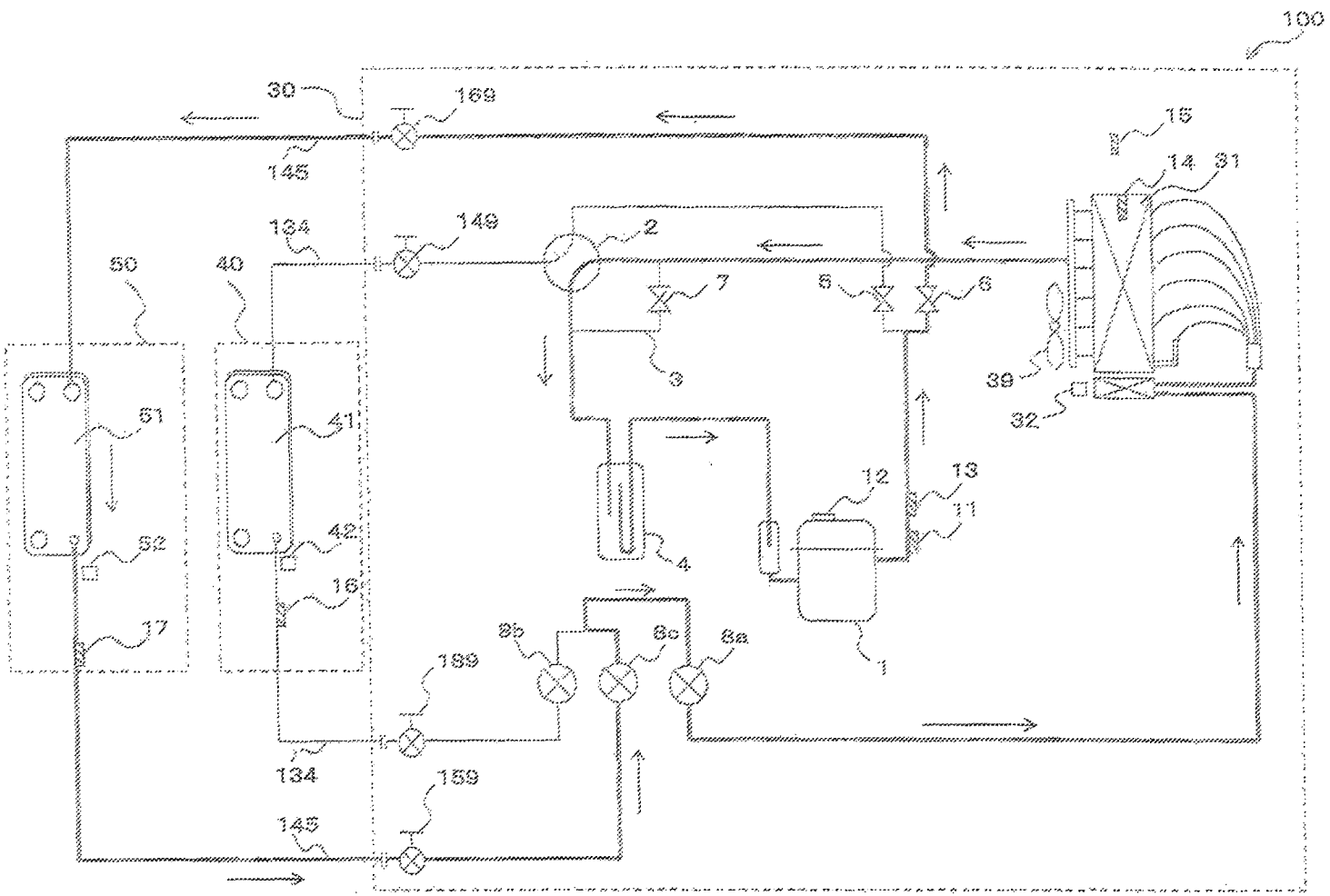
FIG. 4 is a refrigerant circuit diagram of the refrigeration cycle apparatus 100 using an air-side heat exchanger 31 as an evaporator at the time of a hot water supply operation according to Embodiment 1 of the present invention.

FIG. 4 is a refrigerant circuit diagram of the refrigeration cycle apparatus 100 using the air-side heat exchanger 31 as an evaporator at the time of a hot water supply operation according to Embodiment 1 of the present invention. A hot water supply operation of the refrigeration cycle apparatus 100 will be described below with reference to FIG. 4. The arrows in FIG. 4 represent a direction in which a refrigerant flows. The refrigerant circuit at the time of the hot water supply operation is as (1) and (2) described below.

(1) The compressor 1, the second solenoid valve 6, the stop valve 169, the water-refrigerant heat exchanger 51, the stop valve 159, the third pressure reducing device 8*c*, the first pressure reducing device 8*a*, the air-side heat exchanger 31, the four-way valve 2, and the accumulator 4 are connected in order.

(2) The bypass pipe 3 which connects a pipe connecting the air-side heat exchanger 31 to the four-way valve 2 with a pipe connecting the four-way valve 2 to the accumulator 4, is provided. The third solenoid valve 7 is provided on the bypass pipe 3.

At the time of the hot water supply operation, the controller 32 switches the four-way valve 2 so that the hot water supply operation can be performed. The controller 32 controls the first solenoid valve 5, the second solenoid valve 6, and the third solenoid valve 7 so that the first solenoid valve 5 is in a closed state, the second solenoid valve 6 is in an opened state, and the third solenoid valve 7 is in a closed state. The first pressure reducing device 8*a* is set to be fully opened, the second pressure reducing device 8*b* is set to be fully closed, and the third pressure reducing device 8*c* is set to be fully opened.

At the time of the hot water supply operation, the refrigerant which has been discharged from the compressor 1 passes, in order, through the second solenoid valve 6, the stop valve 169, and the refrigerant pipe 145, and then flows into the water-refrigerant heat exchanger 51 of the water indoor unit 50. The refrigerant which has flowed into the water-refrigerant heat exchanger 51, heats water supplied by the water pump, turns into a high-pressure liquid refrigerant, and then flows out of the water-refrigerant heat exchanger 51.

The refrigerant which has flowed out of the water-refrigerant heat exchanger 51 passes, in order, through the refrigerant pipe 145, the stop valve 159, the third pressure reducing device 8*c*, and the first pressure reducing device 8*a*, is decompressed into a low-pressure two-phase refrigerant, and then flows into the air-side heat exchanger 31. The refrigerant which has flowed into the air-side heat exchanger 31 exchanges heat with the outside air, thereby increasing the temperature of the refrigerant. Then, the refrigerant flows out of the air-side heat exchanger 31. The refrigerant which has flowed out of the air-side heat exchanger 31 passes, in order, through the four-way valve 2 and the accumulator 4, and then return to the compressor 1.

The controller 32 determines, based on, for example, whether or not the detected temperature of the outside air temperature sensor 15 is equal to or higher than a threshold temperature, whether to perform the geothermal hot water supply operation as illustrated in FIG. 3 or the hot water supply operation as illustrated in FIG. 4. In the case of performing a heating operation, there are problems such as (1) and (2) described below.

(1) In the case where the air-side heat exchanger 31 is caused to function as an evaporator when the detection value of the outside air temperature sensor 15 is low, frost may be deposited on the air-side heat exchanger 31, thereby degrading the heating efficiency.

(2) In the case where the geothermal-side heat exchanger 41 is caused to function as an evaporator when the detection value of the outside air temperature sensor 15 is high, the difference between the earth temperature and the outside air temperature is small, and the heat collecting efficiency is therefore not sufficient.

Accordingly, for example, in the case where the detected temperature of the outside air temperature sensor 15 is lower than the threshold temperature, the controller 32 causes the first solenoid valve 5 and the second solenoid valve 6 to enter an opened state, stops the outdoor fan 39, and performs the geothermal hot water supply operation in which the geothermal-side heat exchanger 41 is caused to function as an evaporator.

For example, in the case where the detected temperature of the outside air temperature sensor 15 is equal to or higher than the threshold temperature, the controller 32 causes the first solenoid valve 5 to enter a closed state, causes the second solenoid valve 6 to enter an opened state, and performs the hot water supply operation in which the air-side heat exchanger 31 is caused to function as an evaporator.

The above-mentioned threshold temperature is determined, for example, taking into account the temperature at which frost starts to be formed on the air-side heat exchanger 31. Thus, in the case where the controller 32 determines that, during a hot water supply operation, the detected temperature of the outside air temperature sensor 15 is lower than the threshold temperature, the controller 32 performs switching to a geothermal hot water supply operation. Therefore, even if frost starts to be formed on the air-side heat exchanger 31, it is possible to suppress frost deposition on the air-side heat exchanger 31.

In the heat pump system described in Patent Literature 1 and the air-conditioning system described in Patent Literature 2, the air-side heat exchanger and the geothermal-side heat exchanger are provided in parallel, and a refrigerant which has flowed out of the air-side heat exchanger and a refrigerant which has flowed out of the geothermal-side heat exchanger merge together at a downstream portion of the air-side heat exchanger and the geothermal-side heat exchanger. With this merging, even when the outside air temperature is low and the geothermal-side heat exchanger is therefore used, the suction pressure of the compressor is lower than the saturation pressure of the outside air. This poses a problem that an effect of the switching cannot be fully utilized.

Further, with the heat pump system described in Patent Literature 1 and the air-conditioning system described in Patent Literature 2, stagnation of a refrigerant occurs to an air-side heat exchanger which is not being used. Therefore, there is a problem in that a shortage of refrigerant occurs when the compressor starts to operate.

Furthermore, with the heat pump system described in Patent Literature 1 and the air-conditioning system described in Patent Literature 2, although a flow passage can be switched by the four-way valve 2, when the pressure of the air-side heat exchanger is significantly lower than that of the geothermal-side heat exchanger, the two pressures are equalized by leakage of the four-way valve 2. This results in a reduction in the suction pressure which is obtained from ground heat.

On the other hand, with the refrigeration cycle apparatus 100 according to Embodiment 1 of the present invention, the controller 32 controls, when the geothermal-side heat exchanger 41 functions as an evaporator, the switching device so that the air-side heat exchanger 31 and the water-refrigerant heat exchanger 51 are connected in parallel, and stops the outdoor fan 39. This allows an efficient operation even when, in particular, the outside air temperature is low. Thus, the discharge-side connection pipe of the four-way valve 2 becomes high pressure, and it is therefore possible to suppress refrigerant leakage and secure the suction pressure which is obtained from ground heat. Accordingly, when the outside air temperature is low, the influence of the air-side heat exchanger, which is not used as an evaporator, can be reduced compared to related art, and the suction pressure obtained from the geothermal-side heat exchanger, which is used as an evaporator, can be secured compared to related art. Furthermore, stagnation of a refrigerant to the low-temperature air-side heat exchanger 31, which is not used as an evaporator, can be suppressed.

Further, the controller 32 performs either a geothermal hot water supply operation or a hot water supply operation, for example, depending on whether or not the detected temperature of the outside air temperature sensor 15 is equal to or higher than the threshold temperature. For example, in the case where the controller 32 determines, during execution of the hot water supply operation in which the air-side heat exchanger 31 is caused to function as an evaporator, that the detected temperature of the outside air temperature sensor 15 is lower than the threshold temperature for the air-side heat exchanger 31, then the geothermal hot water supply operation is performed. Accordingly, a high-temperature refrigerant which has been discharged from the compressor 1 flows into the air-side heat exchanger 31 functioning as an evaporator. Therefore, for example, even if frost is deposited on the air-side heat exchanger 31, it is possible to remove frost efficiently.

An example has been described above in which the controller 32 performs either the geothermal hot water supply operation or the hot water supply operation, depending on the detected temperature of the outside air temperature sensor 15. However, the present invention is not limited to this. For example, the controller 32 may preform either the geothermal hot water supply operation or the hot water supply operation, based on other sensor information as well as the detected temperature of the outside air temperature sensor 15. Further, the controller 32 may preform either the geothermal hot water supply operation or the hot water supply operation, based on other sensor information, instead of being based on the detected temperature of the outside air temperature sensor 15.

REFERENCE SIGNS LIST

1: compressor, 2: four-way valve, 3: bypass pipe, 4: accumulator, 5: first solenoid valve, 6: second solenoid valve, 7: third solenoid valve, 8*a*: first pressure reducing device, 8*b*: second pressure reducing device, 8*c*: third pressure reducing device, 11: pressure sensor, 12: compressor shell temperature sensor, 13: discharge pipe temperature sensor, 14: air-side heat exchanger temperature sensor, 15: outside air temperature sensor, 16: geothermal temperature sensor, 17: refrigerant temperature sensor, 30: outdoor heat source unit, 31: air-side heat exchanger, 32: controller, 39: outdoor fan, 40: geothermal unit, 41: geothermal-side heat exchanger, 42: controller, 50: water indoor unit, 51: water-refrigerant heat exchanger, 52: controller, 100: refrigeration cycle apparatus, 134: refrigerant pipe, 145: refrigerant pipe, 149: stop valve, 159: stop valve, 169: stop valve, 189: stop valve

The invention claimed is:

1. A refrigeration cycle apparatus comprising: a compressor which compresses a sucked refrigerant and discharges a compressed refrigerant;

a condenser which condenses the compressed refrigerant discharged from the compressor by performing heat exchange with a heat exchange target;

a pressure reducing device which reduces a pressure of the compressed refrigerant;

an air-side heat exchanger which evaporates the compressed refrigerant by performing heat exchange with outside air;

an outdoor fan which delivers air to the air-side heat exchanger;

a geothermal-side heat exchanger which evaporates the compressed refrigerant by performing heat exchange with ground;

a switching device which performs switching of a flow passage so that the air-side heat exchanger or the geothermal-side heat exchanger functions as an evaporator, the switching device including a four-way valve, a first solenoid valve, and a second solenoid valve, the four-way valve connects with the air-side heat exchanger, the first solenoid valve, the geothermal-side heat exchanger, and an accumulator, the first solenoid valve connects with the four-way valve and the compressor, the second solenoid valve connects with the condenser and the compressor; and a controller configured to, when the controller controls the refrigeration cycle apparatus to perform a heating operation:

determine whether a detected temperature of the outside air is equal to or higher than a threshold temperature related to frost formation, responsive to the detected temperature being determined as lower than the threshold temperature related to frost formation, (i) perform a geothermal hot water supply operation in which the geothermal-side heat exchanger functions as the evaporator, (ii) control the switching device so that the air-side heat exchanger and the condenser are connected in parallel and a discharge-side of the four-way valve becomes high pressure, and (iii) stop the outdoor fan, wherein the controller is further configured to perform a hot water supply operation in which the air-side heat exchanger functions as the evaporator in response to the detected temperature being determined as equal to or higher than the threshold temperature, wherein, during the geothermal hot water supply operation:

the controller controls the first solenoid valve to be in an opened state, the second solenoid valve to be in an opened state, and a third solenoid valve provided on a bypass pipe to be in a closed state; the controller controls the pressure reducing device to be fully opened;

a part of the compressed refrigerant which is discharged from the compressor passes, in this order, through the second solenoid valve, a first stop valve, and a refrigerant pipe and then flows into a water-refrigerant heat exchanger, acting as the condenser, of a water indoor unit; the compressed refrigerant which has flowed into the water-refrigerant heat exchanger heats water supplied to the water indoor unit, turns into a high-pressure liquid refrigerant, and then flows out of the water-refrigerant heat exchanger; the high-pressure liquid refrigerant which has flowed out of the water-refrigerant heat exchanger flows into an outdoor heat source unit through the refrigerant pipe and passes, in this order, through a second stop valve, the pressure reducing device, and is decompressed into a low-pressure two-phase refrigerant; the low-pressure two-phase refrigerant passes through a third stop valve and the refrigerant pipe and then flows into the geothermal-side heat exchanger; the low-pressure two-phase refrigerant which has flowed into the geothermal-side heat exchanger exchanges heat, and flows out of the geothermal-side heat exchanger; the low-pressure two-phase refrigerant which has flowed out of the geothermal-side heat exchanger passes, in this order, through the refrigerant pipe, a fourth stop valve, the four-way valve, and the accumulator, and then returns to the compressor; and the compressed refrigerant which has been discharged from the compressor and has not passed through the second solenoid valve passes, in this order, through the first solenoid valve and the four-way valve, and then flows into the air-side heat exchanger; the controller stops the outdoor fan; and the compressed refrigerant which has flowed out of the air-side heat exchanger passes through another pressure reducing device, and merges with the high-pressure liquid refrigerant which has flowed out of the water-refrigerant heat exchanger.

2. The refrigeration cycle apparatus of claim 1, further comprising:

an outside air temperature sensor which detects, as the detected temperature, a temperature of the outside air, wherein when the detected temperature detected by the outside air temperature sensor is lower than the threshold temperature related to frost formation, the controller is further configured to control the switching device so that the geothermal-side heat exchanger functions as the evaporator.

3. The refrigeration cycle apparatus of claim 2, wherein the controller controls the switching device so that the geothermal-side heat exchanger functions as the evaporator, based on a detection value of the outside air temperature sensor and at least one of the detection values of a pressure sensor which detects a discharge pressure of the compressor, a geothermal temperature sensor which detects a temperature of the geothermal-side heat exchanger, and a refrigerant temperature sensor which detects a temperature of the condenser.

4. The refrigeration cycle apparatus of claim 2, wherein in a case where defrosting of the air-side heat exchanger is performed, the controller is further configured to control the switching device so that that the geothermal-side heat exchanger functions as the evaporator.

5. The refrigeration cycle apparatus of claim 2, wherein the outdoor fan causes the outside air to exchange heat with the compressed refrigerant flowing through the air-side heat exchanger by blowing the outside air across a surface of the air-side heat exchanger.

6. The refrigeration cycle apparatus of claim 2, wherein the compressed refrigerant which is discharged from the compressor flows into the air-side heat exchanger, and the compressed refrigerant which flows out of the air-side heat exchanger merges with the compressed refrigerant which flows out of the condenser, when the air-side heat exchanger and the condenser are connected in parallel during the geothermal hot water supply operation.

7. The refrigeration cycle apparatus of claim 1, wherein in a case where defrosting of the air-side heat exchanger is performed, the controller is further configured to control the switching device so that that the geothermal-side heat exchanger functions as the evaporator.

8. The refrigeration cycle apparatus of claim 1, wherein the outdoor fan causes the outside air to exchange heat with the compressed refrigerant flowing through the air-side heat exchanger by blowing the outside air across a surface of the air-side heat exchanger.

9. The refrigeration cycle apparatus of claim 1, wherein the compressed refrigerant which is discharged from the compressor flows into the air-side heat exchanger, and the compressed refrigerant which flows out of the air-side heat exchanger merges with the compressed refrigerant which flows out of the condenser, when the air-side heat exchanger and the condenser are connected in parallel during the geothermal hot water supply operation.

* * * * *